United States Patent [19]

Koo

[11] Patent Number: 4,825,554

[45] Date of Patent: May 2, 1989

[54] CAN OPENERS

[75] Inventor: Hong W. V. Koo, Kowloon, Hong Kong

[73] Assignee: Mike & Kremmel Limited, Hong Kong

[21] Appl. No.: 147,127

[22] Filed: Jan. 21, 1988

Related U.S. Application Data

[63] Continuation of Ser. No. 864,066, May 16, 1986, abandoned.

[30] Foreign Application Priority Data

May 17, 1985 [GB] United Kingdom ..... 8512549

[51] Int. Cl.[4] ..... B67B 7/72

[52] U.S. Cl. ..... 30/417; 30/426

[58] Field of Search ..... 30/417, 418, 422, 424–427, 30/430, 431

[56] References Cited

U.S. PATENT DOCUMENTS

| | | | |
|---|---|---|---|
| 2,354,469 | 7/1944 | Lubetsky | 30/422 X |
| 2,573,031 | 10/1951 | LaForte | 30/422 |
| 4,363,818 | 1/1986 | Kreth et al. | 30/426 |

*Primary Examiner*—Douglas D. Watts

*Attorney, Agent, or Firm*—Townsend and Townsend

[57] ABSTRACT

A can opener providing a circular cut around the cylindrical wall of a can below the lid and rim which are severed by the cut from the rest of the can. A pair of body members having integrally formed handles are pivoted to one another. A rotatable spindle attached to a driving wheel drives the can opener. A cutting wheel forms a nip with the driving wheel in an operating position to force the cutting edge to penetrate through the wall of the can. A mounting plate carrying the cutting wheel is slidably supported by one body member and is movable by cam means between the operating position and a retracted position as the body members are pivoted between their limits of pivoting. The cam means comprise a curved slot and pin positioned between the mounting plate and the other body member and the slot has a portion at one end which is substantially transverse to the axis of sliding of the mounting plate when the mounting plate is in the operating position and an intermediate portion which curves away from the portion at one end.

9 Claims, 5 Drawing Sheets

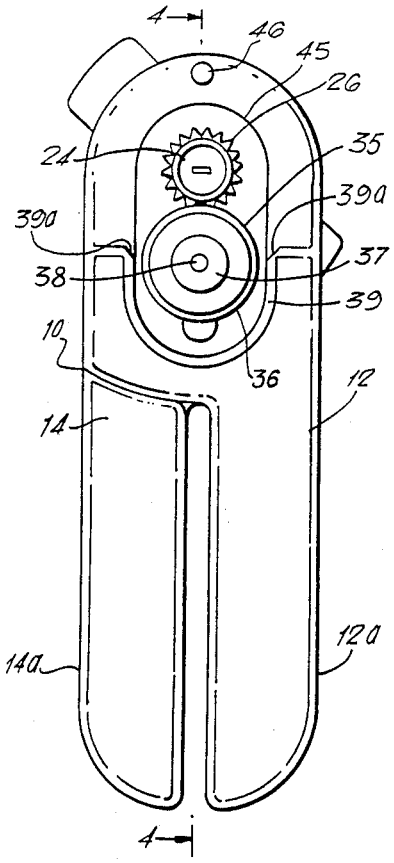
FIG. 1.
FIG. 2
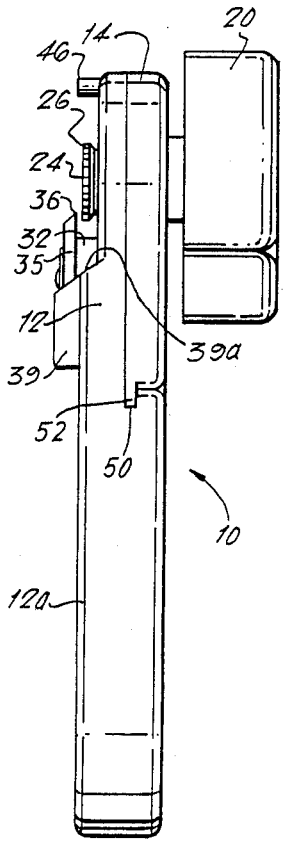

CAN OPENERS

This is a continuation of application Ser. No. 864,066 filed May 16, 1986, now abandoned.

BACKGROUND TO THE INVENTION

Although many different designs of can openers are known, very few work really satisfactorily. In many instances, the cutting edge is liable to become jammed and a ragged cut given which can be dangerous to the user. Also small filings of metal may be generated which contaminate the contents of the can.

U.S. Pat. No. 4,563,818, which corresponds to European Application No. 84304750.7 describes a hand-held can opener intended to provide a cut around the wall of the can below the lid and rim which are severed by the cut from the rest of the can, the can opener comprising a pair of body members pivotally joined to one another, each body member having an integrally-formed handle extending generally away from the point of pivoting and movable between a more open position and a more closed position, the handles being intended to be grasped by one hand of the user in the more closed position, a spindle to which is attached a driving wheel to be brought into contact with the lip of the lid of a can, the spindle being manually rotatable to cause the driving wheel to orbit the can opener relatively around the top of the can, a cutting wheel which, in an operating cutting position, forms a nip with the driving wheel so that the cutting edge of the cutting wheel is forced to penetrate through the wall of the can and provide a cut around the can as the opener orbits relatively around the can, a mounting plate slidably supported by one of the body members and on which the cutting wheel is rotatably mounted, the mounting plate being movable between the operating cutting position where the driving wheel forces the cutting edge to penetrate the can wall and an inoperative position where the cutting wheel is moved, e.g. substantially radially relative the axis of rotation of the cutting wheel, away from the driving wheel, and cam means for moving the plate and the supported cutting wheel to the cutting position as the handles are pivoted towards the more closed position and moving it away to its inoperative position when the handles are pivoted away from that said limit of pivoting towards the more open position.

Such a can opener has been found to give a good clean cut without ragged edges and substantially without the formation of dangerous metal filings. In addition, the can opener can usually operate successfully even if the can is quite seriously damaged and dented. Further the can opener will work both on conventional cylindrical shaped tins and on tins of other shapes, e.g. oval or square.

The cam means bring the cutting wheel to its operative cutting position upon quite a small angular pivoting movement of the body portions, e.g. a maximum opening of 30°. Thus the pivoting of the body members can be limited in extent. This has advantages over, for example, the can opener described in co-pending United Kingdom Application No. 8303320, publication No. 2118134,where it is necessary to pivot the handles over about 180° in order to open up the cutting nip between the driving wheel and the cutting wheel.

As described in U.S. Pat. No. 4,563,813 noted above, the cam means can comprise a slot, e.g. a substantially straight slot inclined at an angle to the axis of sliding of the mounting plate and formed in the other body member, i.e. the one which does not slidably support the mounting plate, and a pin projecting from the mounting plate into that slot, although the positioning of the slot and pin could be reversed. We have now discovered, however that there are advantages if the slot is not straight but curved.

BRIEF SUMMARY OF THE INVENTION

Therefore according to this invention there is provided between the mounting plate and the said other body member, to move the mounting plate relative the said one body member, a curved slot engaged by a pin projecting into that said curved slot, the curved slot having a portion at one end which is substantially transverse to the axis of sliding of the mounting plate when the handles are in their more closed position, i.e. when the mounting plate is in the operating position, and an intermediate portion which curves away from that said end portion to provide a larger degree of movement of the mounting plate as the handles move towards the more open position.

Thus, according to one embodiment of the unit the can opener comprises a pair of body members pivotally joined to one another, each body member having an integrally-formed handle extending generally away from the point of pivoting and movable between a more open position and a more closed position, the handles being intended to be grasped by one hand of the user in the more closed position, a spindle to which is attached a driving wheel to be brought into contact with the lip of the lid of a can, the spindle being rotatable to cause the driving wheel to orbit the can opener relatively around the top of the can, a cutting wheel which, in an operating cutting position, forms a nip with the driving wheel so that the cutting edge of the cutting wheel is forced to penetrate through the wall of the can and provide a cut around the can as the opener orbits relatively around the can, a mounting plate slidably supported by one of the body members and on which the cutting wheel is rotatably mounted, the sliding plate being movable between the operating cutting position where the driving wheel forces the cutting edge to penetrate the can wall and an inoperative position where the cutting wheel is moved relative the axis of rotation of the cutting wheel, away from the driving wheel, between the mounting plate and the said other body member, between the mounting plate and the said other body member, to move the mounting plate relative the said one body member, a curved slot engaged by a pin projecting into that said curved slot, the curved slot having a portion at one end which is substantially transverse to the axis of sliding of the mounting plate when the handles are in their more closed portion and an intermediate portion which curves away from that said end portion, whereby the plate and supported cutting wheel are moved to the cutting position as the handles are pivoted towards the more closed position and moved away to its inoperative position when the handles are pivoted away from that said limit of pivoting towards the more open position.

An advantage of this arrangement is that as the handles are pivoted from their more open position, the mechanical advantage of the cam arrangement formed by the slot and pin changes. Thus initially the plate and supported cutting wheel advance a relatively large extent for a relatively small degree of pivoting. This is satisfactory since there is little resistance to the advance of the cutting wheel until it contacts the rim of the can.

As the handles progressively pivot to the closed position, because of the curvature of the slot, the extent of advance decreases in proportion to the degree of pivoting. In this way progressively larger forces can be imparted to the cutting wheel as it approaches and pierces the wall of the cam. Finally as the handles reach their closed position, the pin reaches that part of the slot which is substantially transverse to axis of movement of the plate. In this position the slot acts as a lock since no matter how large the force applied to the plate to try to open the nip between the cutter wheel and driving wheel, this will not produce a corresponding force tending to pivot the handles to their more open position.

By way of example, the intermediate portion of the slot can curve through an angle of order of 39°, or more generally from about 30° to about 55°, or preferably from 35° to 43°.

Preferably the slot has a portion at its other end, which is substantially straight and angled relative the portion at the said one end at an angle of order of 39° or more generally from about 35° to about 55°, and preferably from 35° to 43°.

A further advantage which we find is that the edges of the slot do not need to be reinforced with a metal insert and it is sufficient for the slot to be moulded into the synthetic plastics material of the handle and for the mounting plate and the pin also to be made of synthetic plastics material.

Preferably an upstanding guard is integrally formed on the said other body member, the guard protecting the user from accidentally touching the cutting wheel.

There may be an abutment upstanding from the said other body member which acts to eject or release a severed can lid from the nip between the cutting wheel and the driving wheel as the cutting wheel moves to its inoperative position. This could be an edge inclined to the direction of movement of the cutting wheel between its operative and inoperative positions, that edge being, for example, constituted by the ends of the upstanding guard. Alternatively the knife could retract into a pouch whose open edge constitutes that said edge.

Preferably the axis of the manually rotatable spindle on which the driving wheel is mounted coincides with the axis of pivoting of the two body members.

The driving wheel and the spindle to which it is connected can be manually driven, e.g. by means of a two-armed crank attached to the free end of the spindle. Alternatively, the can opener could be a hand-held electric can opener and the spindle could be motor driven with one of the handles including additionally a housing for the electric motor.

As described in European Patent Application No. 86300567.4 it is preferred that between each handle and the other body member are provided cooperating flanges and recesses such that the engagement of one flange in the cooperating recess reinforces the overall can opener and prevents twisting of the handles relative one another when under a can opening or pivoting load.

BRIEF DESCRIPTION OF THE DRAWINGS

A can opener according to the invention will now be described, by way of example, with reference to the accompanying drawings, in which:

FIG. 1 is a front view of a can opener according to the invention shown in its closed operative position;

FIG. 2 is a side view of the can opener shown in FIG. 1;

DESCRIPTION OF THE PREFERRED EMBODIMENTS

Figure 3:
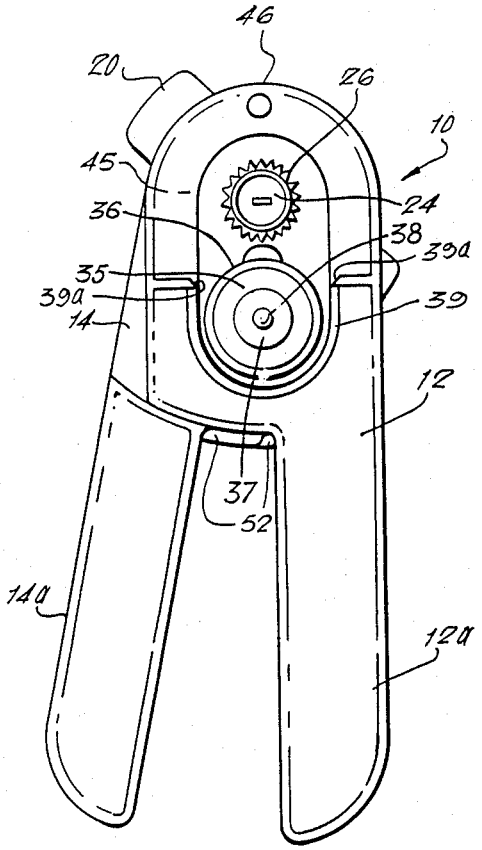
FIG. 3 is a view similar to FIG. 1 but with the can opener in its open non-operative position.
Figure 4:
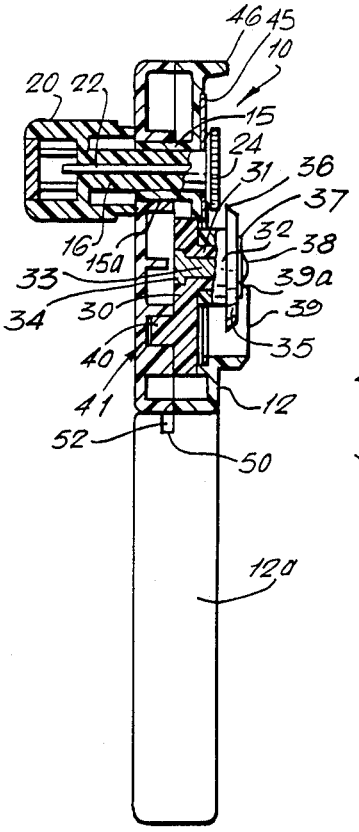
FIG. 4 is a section taken on the line 4—4 of FIG. 1.

The can opener 10 shown in the drawings includes two body portions 12 and 14. The two portions are pivoted to one another about a circular upstanding hollow spigot 15 on the portion 12 which extends into a circular hole 15*a* on the portion 14. Extending axially through the spigot 15 and hole 15*a* is a spindle 16 (FIG. 4). The body portions are therefore pivotable between a closed working position shown in FIG. 1 and an open position shown in FIG. 3.

The body portions 12 and 14 each include an integral handle 12*a* and 14*a*, respectively, extending generally away from the axis of the spindle 16 such that they lay closely alongside and parallel to one another in the closed position shown in FIG. 1. Conveniently the two body portions are moulded from synthetic plastics material, e.g. polypropylene.

Integrally formed at one end of the spindle is a two-armed crank 20 for use in manually rotating it. Axially embedded in the spindle is a metal reinforcing shaft 22, one end of which latter extends slightly beyond the end of the spindle 16 and is attached to a driving wheel 24. The latter is dish-shaped and has an outer toothed edge 26 capable of frictionally engaging the lip 28 of the lid 27 of a can 29 (FIG. 7) and driving the can opener around the can during opening.

Figure 5:
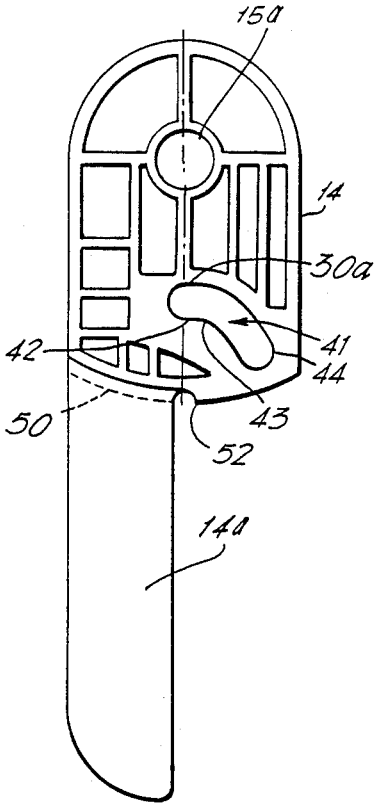
FIG. 5 is an elevation of one of the body members shown separately from the rest of the can opener.
Figure 6:
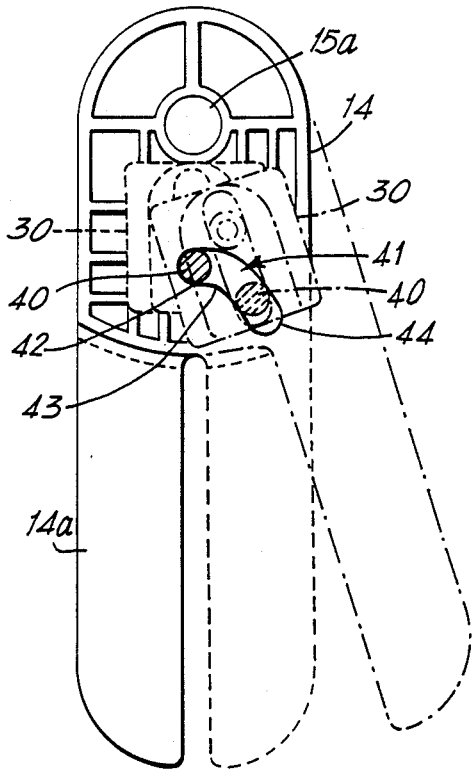
FIG. 6 is a diagram similar to FIG. 5 illustrating the way in which the cutter wheel is moved.

Slidably mounted in the body portion 12 is a rectangular plate 30 constrained to move along an axis 30*a* (see FIG. 5). Extending outwardly from one face of the plate is an integral sleeve 31 on which is rotatably mounted a sleeve 32 of synthetic plastics material. A metal pin 33 is positioned axially of the sleeve 31 and its head 34 is embedded in the body of the plate 30. Rotatably connected to the sleeve 32 and positioned outwardly of it is a metal cutting wheel 35 having a pointed circular cutting edge 36. The sleeve 32 is intended to bear against the lip of the can and be rotated as the can opener advances around the can, the cutting wheel 35 being rotated at the same time because of its rotatable connection with the sleeve. A washer 37 is positioned outside the cutting wheel 35, and the sleeve 32. The wheel 35 and washer 37 are held in place by the riveting over of the end 38 of the pin 33.

Integrally formed with the body portion 12 is an upstanding U-shaped guard 39. This shields the cutting wheel to prevent the user from accidentally cutting himself. The guard 39 has at its ends edges 39*a* which are inclined to the axis 30*a*. At the end of a can opening operation the severed lid is trapped and held between the cutting wheel 35 and driving wheel 24. Therefore, as the cutting wheel is withdrawn after a can has been opened, the lid of the can will abut these edges 39*a* and be forced from beneath the edge of the cutting wheel 35 and so automatically released for disposal.

Projecting from the opposite face of the plate 30 is an integral cam pin 40. This engages in a slot 41 formed in the body portion 14. The slot comprises an initial straight end portion 42 which is transverse to the axis 30*a*. The slot has an intermediate curved portion 43 where the slot curves through an angle of about 39°. Finally the slot has a straight end portion 44 inclined at about 39° to the end portion 42. As the handles 12*a* and 14*b* are moved between the open position shown in FIG. 3 and the closed position shown in FIG. 1, the plate 30 is cammed from a lower position to an upper operating position shown in FIG. 4 by the engagement of the pin 40 in the slot 41. As a result the cutting wheel 35 also moves from its non-operating position shown in FIG. 3 where its cutting edge 36 is spaced sufficiently from the driving wheel 24 for it to fit over the lip 28 of a can 29 to its operating and cutting position shown in FIG. 1 where the cutting edge 36 slightly overlaps the driving wheel 26.

An advantage of this arrangement is that as the handles are pivoted from their more open position, the mechanical advantage of the cam arrangement formed by the slot and pin changes. Thus initially the plate and supported cutting wheel advance a relatively large extent for a relatively small degree of pivoting of the handles 12*a* and 14*a* because the pin 40 engages the portion 44 of the slot. This is satisfactory since there is little resistance to advance of the cutting wheel until it contacts the rim of the cam. As the handles progressively pivot to the closed position, because of the curvature of the slot, the extent of advance decreases in proportion to the degree of pivoting. At this stage the pin 40 is engaging the portion 43 of the slot 41. In this way progressively larger forces can be imparted to the cutting wheel as it approaches and pierces the wall of the can. Finally as the handles reach their closed position, the pin 40 reaches that portion 42 of the slot which is substantially transverse to axis of movement of the plate. In this position the slot and pin act as a lock since no matter how large the force applied to the plate 30 to try to open the nip between the cutter wheel 35 and driving wheel 24, this will not produce any significant corresponding force tending to pivot the handles 12*a* and 14*a* to their more open position.

Another advantage is that the pin 40 is moulded centrally of the plate 30, i.e. it is on the axis 30*a* together with the axis of rotation of the cutting wheel 35. This helps to promote smooth sliding of the plate 30 in the body portion 14.

Figure 7:
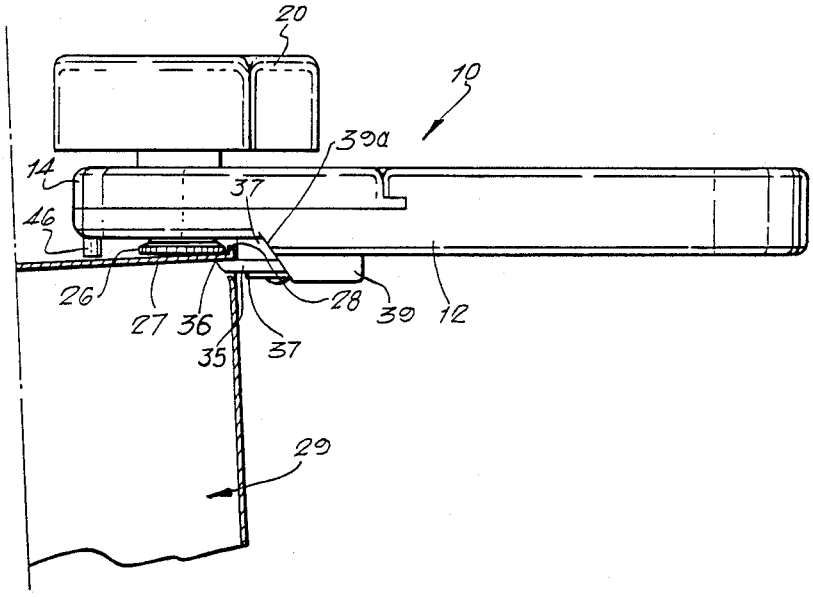
FIG. 7 is a view showing the can opener in use in opening a can.

This cutting position is also shown in FIG. 7 and the cutting edge 36 is there shown as penetrating the top edge of the cylindrical wall of the can just beneath the lid 27. Therefore, upon rotation of the crank 20, the can opener 10 is driven in a circular orbit around the top of the can in the case of a cylindrical can and a circular cut is made in the cylindrical wall of the can near its top. Once a circular cut is complete, the top of the can can be lifted cleanly off and is held trapped between the cutting wheel 35 and driving wheel 24 until the handles are brought into the open position shown in FIG. 3 when the top is ejected by contact with the edges 39*a*.

A metal plate 45 is embedded in the face of the body portion 12 to provide protection for the plastic material of that body when it comes into contact with a rim of a can during opening. The surface of the metal plate 45 is slightly proved relative the body portion 12.

To assist in maintaining the position of the can opener during its cutting, a small lug 46 is integrally formed with the portion 12 and extends generally parallel to the axis of the spindle 16. Its end bears on the top of the lid 27 and keeps the can opener relatively level.

The can opener 10 is simple to make and operate and can also be kept clean and hygienic.

At the inner end of each handle 12*a* or 14*a* is provided an arcuate recess 50. A corresponding arcuate shaped flange 52 is integrally formed on each body portion 14 or 12 respectively. The flanges 52 slidably engage in their respective recesses 50 and their arcuate shape allows the handles to open and close without hindrance. The engagement of the flanges 52 in their respective recesses 50 does however prevent twisting of the handles 12*a* and 14*a* when under excessive loads which might cause the body members to open sufficiently for the cam pin 40 to become disengaged from the slot 44. When the handles are in the open position only a relatively short portion of each flange 52 is engaged in its respective recess 50 but at such times the twisting forces are unlikely to be large. However as the handles progressively close and once they are completely closed, the recesses engage a progressively longer length of the flange and so are capable of resisting the resulting larger forces which may be encountered during the opening of a can.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A can opener intended to provide a cut around a wall of a can below a lid and rim thereof which are severed by the cut from the rest of the can, the can opener comprising first and second body members pivotably joined to one another, each body member having an integrally formed handle extending generally away from the point of pivoting and moveable between a more open position and a more closed position, the handles being adapted to be grasped by one hand of the user in the more closed position, a driving wheel capable of rotation to engage the rim of the can and to orbit the can opener relatively around the top of the can, a cutting wheel which, in a cutting position, forms a nip with the driving wheel so that the cutting edge of the cutting wheel is forced to penetrate through the wall of the can and provide a cut around the can, a mounting plate slidable supported by the first body member and on which the cutting wheel is rotatably mounted, a curbed slot and a pin projecting into that slot defined by the mounting plate and the second body member, the slot and pin cooperating to advance and retract the cutting wheel and driving wheel relatively one another to establish the said nip in the advanced position as the body members pivot relative one another and force the cutting wheel to penetrate through the can wall, whereby the wheels advance relatively as the handles move towards the more closed position and retract relatively as the handles move towards the more open position, the curved slot having an end portion at one end which is substantially transverse to the direction in which the mounting plate slides when the handles are in their more closed position to provide a relatively lesser degree of movement of the mounting plate when the handles move whole proximate their more closed position, and an intermediate portion which curves away from that said end portion to provide a relatively larger degree of movement of the mounting plate when the handles move while remote from their more closed position.

2. A can opener as claimed in claim 1 in which the intermediate portion of the slot bends through an angle of about 30° to about 55°.

3. A can opener as claimed in claim 2 in which the intermediate portion of the slot bends through an angle of from 35° to 43°.

4. A can opener as claimed in claim 1 in which the slot has a portion at its other end which is substantially straight and angled relative the portion at the said one end.

5. A can opener as claimed in claim 1 in which the slot is formed in the second body member and the pin projects from the mounting plate into the slot.

6. A can opener as claimed in claim 1 in which the axis of rotation of the driving wheel coincides with the axis of pivoting of the two body members.

7. A can opener as claimed in claim 1 in which an upstanding guard is integrally formed on a body member to protect the user from accidentally touch the cutting wheel.

8. A can opener as claimed in claim 7 in which the end or ends of the guard include an edge inclined to the direction of retraction of the cutting wheel relative the driving heel, that inclined edge acting to eject a severed can lid from the nip between the cutting wheel and the driving wheel as the cutting wheel retracts relative the driving wheel.

9. A can opener as claimed in claim 1 which comprises an abutment upstanding from a body member, the abutment acting to eject a severed can lid from the nip between the cutting wheel and the driving wheel as the cutting wheel is retracted relative the drive wheel.

* * * * *